US006945490B1

(12) United States Patent
Zollinger

(10) Patent No.: US 6,945,490 B1
(45) Date of Patent: Sep. 20, 2005

(54) TRAVELING YARN TENSION COMPENSATING SYSTEM

(76) Inventor: Richard V. Zollinger, 10 Donald Rd., Cowpens, SC (US) 29330

( * ) Notice: Subject to any disclaimer, the term of this patent is extended or adjusted under 35 U.S.C. 154(b) by 68 days.

(21) Appl. No.: 10/625,940

(22) Filed: Jul. 24, 2003

(51) Int. Cl.[7] ..... B65H 59/22; B65H 59/36

(52) U.S. Cl. ..... 242/419.1; 242/419.6; 242/419.7; 242/419.9; 242/152.1; 242/153

(58) Field of Search ..... 242/419, 419.1, 242/419.6, 419.7, 419.9, 152.1, 153; 226/195

(56) References Cited

U.S. PATENT DOCUMENTS

| | | | | | |
|---|---|---|---|---|---|
| 235,261 | A | * | 12/1880 | Leigh | 242/419.7 |
| 1,904,420 | A | * | 4/1933 | Dickhaut | 242/419.1 |
| 3,263,297 | A | * | 8/1966 | Manning | 242/419.7 |
| 3,540,674 | A | * | 11/1970 | Okamura et al. | 242/419.1 |
| 3,556,904 | A | * | 1/1971 | Hinds | 242/419.1 |
| 4,017,038 | A | | 4/1977 | Paepke | 242/152.1 |
| 4,083,514 | A | | 4/1978 | Levin | 242/152.1 |
| 4,095,757 | A | | 6/1978 | Singer | 242/152.1 X |
| RE31,024 | E | | 9/1982 | Zollinger | 242/152.1 |
| RE31,041 | E | | 9/1982 | Zollinger | 242/152.1 |
| 4,406,424 | A | | 9/1983 | McBride | 242/152.1 |
| 4,470,559 | A | | 9/1984 | McBride, Jr. | 242/152.1 |
| 4,516,738 | A | | 5/1985 | Nürk | 242/152.1 |
| 4,558,834 | A | | 12/1985 | Plucknett | 242/152.1 |
| 4,568,038 | A | | 2/1986 | Frentzel-Beyme | 242/152.1 |
| 4,807,829 | A | | 2/1989 | Zollinger | 242/152.1 |
| 5,820,050 | A | | 10/1998 | Zollinger | 242/152.1 |
| 5,842,661 | A | * | 12/1998 | Hohne et al. | 242/419.1 |

* cited by examiner

*Primary Examiner*—John M. Jillions
(74) *Attorney, Agent, or Firm*—Kennedy Covington Lobdell & Hickman, LLP

(57) ABSTRACT

A traveling yarn tension compensating system having a pair of vertically disposed, horizontally spaced ball-type yarn tensioning units and a yarn tension compensating device disposed therebetween. The device has a yarn engaging element with a yarn engaging surface that is downwardly convex for engaging a yarn thereunder. The surface is fixed so as not to rotate or otherwise move in the direction of travel of the yarn and is made of a material that imposes a tension increasing frictional drag on the traveling yarn. The surface engaging element is mounted to be freely movable vertically in response to tension in the traveling yarn. The convex shape of the yarn engaging surface results in a greater extent of surface engagement of the yarn when the surface engaging element is in a lower position resulting from lesser tension in the yarn and at which position it deflects the yarn downwardly over the yarn guides. When there is greater tension in the traveling yarn, the yarn raises the surface engaging element to upper positions at which the extent of surface contact by the surface and the yarn guides is less.

16 Claims, 13 Drawing Sheets

TRAVELING YARN TENSION COMPENSATING SYSTEM

FIELD OF THE PRESENT INVENTION

The present invention relates to maintaining uniform tension in a traveling yarn being fed to a machine for manufacturing textiles.

BACKGROUND OF THE PRESENT INVENTION

Maintaining uniform tension in yarn being fed to machines utilized in the manufacturing of textile products has long been an important factor effecting the productivity of the manufacturing process and the quality of the textile product produced. Variations in yarn tension can result in undesirable variations in the product produced with the yarn, thereby effecting the quality of the product. In severe cases, the product or portions of the product may not be usable or the equipment may be stopped because of a wide tension variation.

Many attempts have been made to control yarn tension so that a relatively uniform yarn tension is present in the yarn when it is fed to a yarn processing machine. The best of these has proven to be ball-type yarn tensioning units, such as disclosed in Zollinger U.S. Reissue Pat. No. RE.31,024 and in Zollinger U.S. Pat. No. 5,820,050. In a particularly effective system, specially applicable to maintain uniform tension when feeding relatively large size yarns at moderate speeds, is a combination of the ball-type yarn tension units disclosed in the aforesaid patents. An arrangement such as this is illustrated in FIG. 1, which illustrates the two ball-type yarn tensioning units mounted on a frame at a generally horizontal spacing with yarn being fed upwardly from a package through the ball-type yarn tensioning unit of the aforesaid U.S. Pat. No. 5,820,050 and from that unit across the space between the units and into and down through a ball-type yarn tension unit of the type disclosed in U.S. Reissue Pat. No. RE.31,024, from which the yarn exits to a textile machine, such as a cabler.

SUMMARY OF THE PRESENT INVENTION

Briefly summarized, the present invention is a traveling yarn tension compensating system that applies varying resistance to the traveling yarn by friction engagement that varies in response to the tension in the yarn being fed to the system. Thus, the system applies greater frictional resistance to a yarn that is initially at a low degree of tension and applies lesser frictional resistance to a yarn of higher initial tension.

This is accomplished by guiding a traveling yarn between two spaced yarn guiding devices with a yarn tension compensating device disposed between the guiding devices for engaging the traveling yarn. The yarn tension compensating device has a yarn engaging surface that applies frictional restraint to the traveling yarn, as do the guiding devices, with the frictional restraint being responsive to variations in tension in the traveling yarn to increase or decrease the tension as a result of the amount of deflection in the traveling yarn. Preferably, the yarn engaging surface is convex with the greatest extent of frictional yarn engagement on the convex surface being when the tension in the yarn otherwise is relatively low and the extent of frictional engagement being less when the tension in the yarn is otherwise greater.

In a preferred embodiment, the convex yarn engaging surface is formed on a movable element that has a vertical component of movement for movement from a lower position at which there is less tension in the yarn traveling to the system and there is greater frictional engagement to upper positions in response to greater tension in the yarn being fed to the system and at which there is lesser frictional engagement with the yarn. Thus, tension is being increased or decreased in the yarn by the system in reverse to the tension in the yarn entering the system.

Preferably, to create desired friction, the yarn engaging surface is restrained so that it is not free to move at the same surface speed as the traveling yarn, or it is fixed against any movement in the direction of yarn travel.

Preferably, the element on which the yarn engaging surface is formed is freely movable in a substantially vertical direction in response to the tension in the traveling yarn entering the system. This is accomplished in the preferred embodiment by the movable element on which the yarn engaging surface is formed being a movable slide positioned for movement in a generally vertically extending slide guide, with the guide being at an inclination to the vertical in a direction inclined toward the yarn guiding device to which the yarn is traveling, allowing the guided element to respond more freely to an increase in tension in the traveling yarn.

In the preferred embodiment, the yarn guiding devices are ball-type yarn tensioning units mounted on a frame on which the yarn tension compensating device is also mounted for guiding of the yarn upwardly through one of the units, generally horizontally over the top surface of the unit, to and past the yarn tension compensating device, over the top surface of the other unit and down through the other unit.

In some cases, yarn being fed from a package or other source to the system may balloon or fly to such an extent that it could become entangled in the yarn compensating device. To avoid this, the yarn compensating device of the present invention may be formed to provide a yarn deflecting surface above the yarn engaging surface and extending downwardly and outwardly to deflect any such possibly entangling yarn away from the yarn tension compensating device.

BRIEF DESCRIPTION OF THE DRAWINGS

Further features, embodiments, and advantages of the present invention will become apparent from the following detailed description with reference to the drawings, wherein.

DETAILED DESCRIPTION OF PREFERRED EMBODIMENTS

Figure 1:
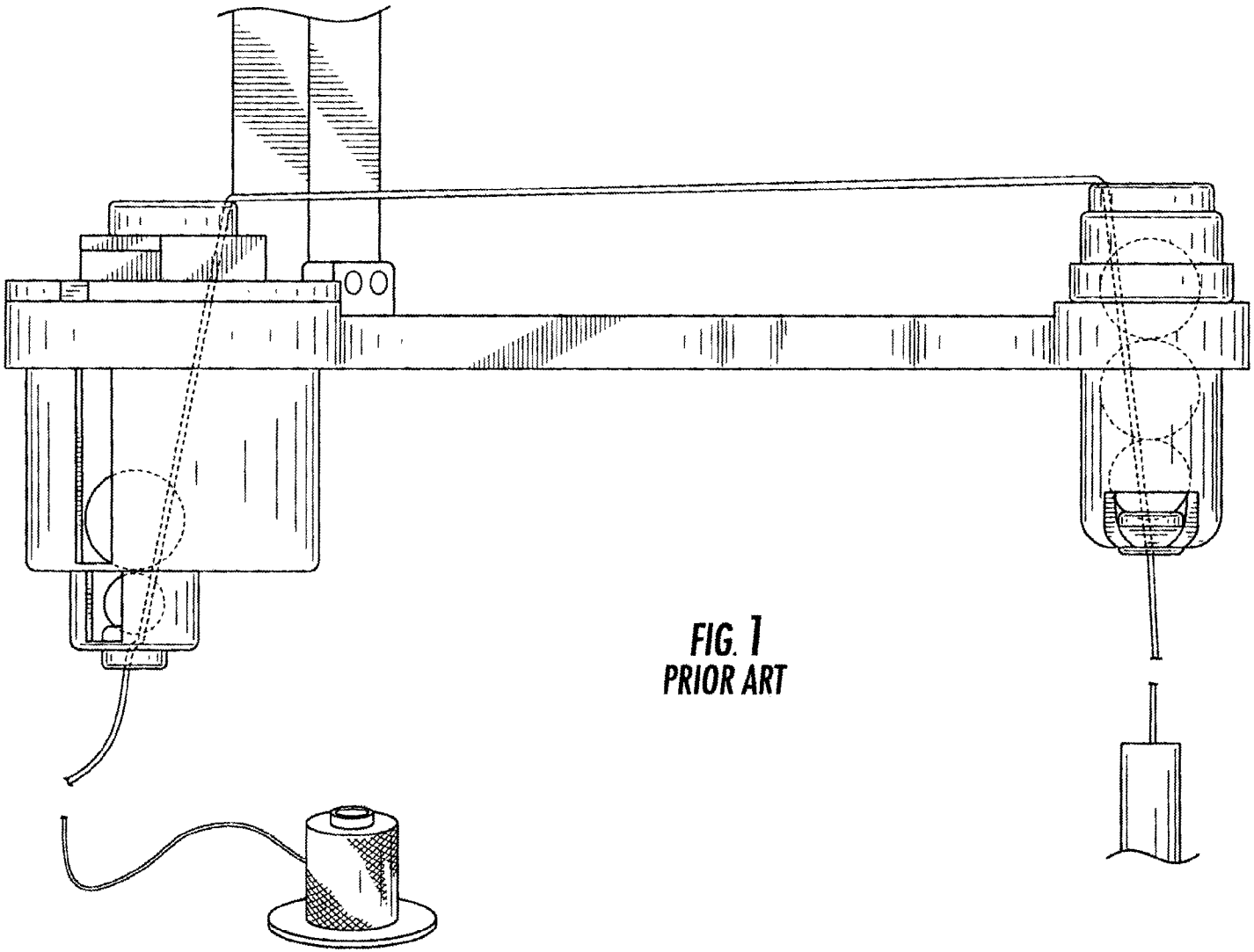
FIG. 1 PRIOR ART
FIG. 1 is an illustration of a prior art yarn tensioning system without the tension compensating device of the present invention.

The preferred embodiment of the traveling yarn tension compensating system 10 of the present invention illustrated in the accompanying drawings includes a pair of spaced yarn guiding devices 11 with a yarn tension compensating device 13 disposed therebetween. The system is located in the line of supply of a yarn from a supply package 15 to and through the system 10 and into a feed tube leading to a textile machine, such as a cabler. However, the system 10 of the present invention is applicable to use with various other types of textile machines that utilize yarn in the manufacture of a textile product.

The yarn guiding devices 11 and 12 and the yarn tension compensating device 13 are mounted on a frame 17 that is attached to a structural component 18 of the textile machine by nut and bolts 19 or any other attachment means. The frame 17 supports the yarn guiding devices 11 and 12 and the tension compensating device 13 in generally horizontal alignment.

Figures 2, 2A:
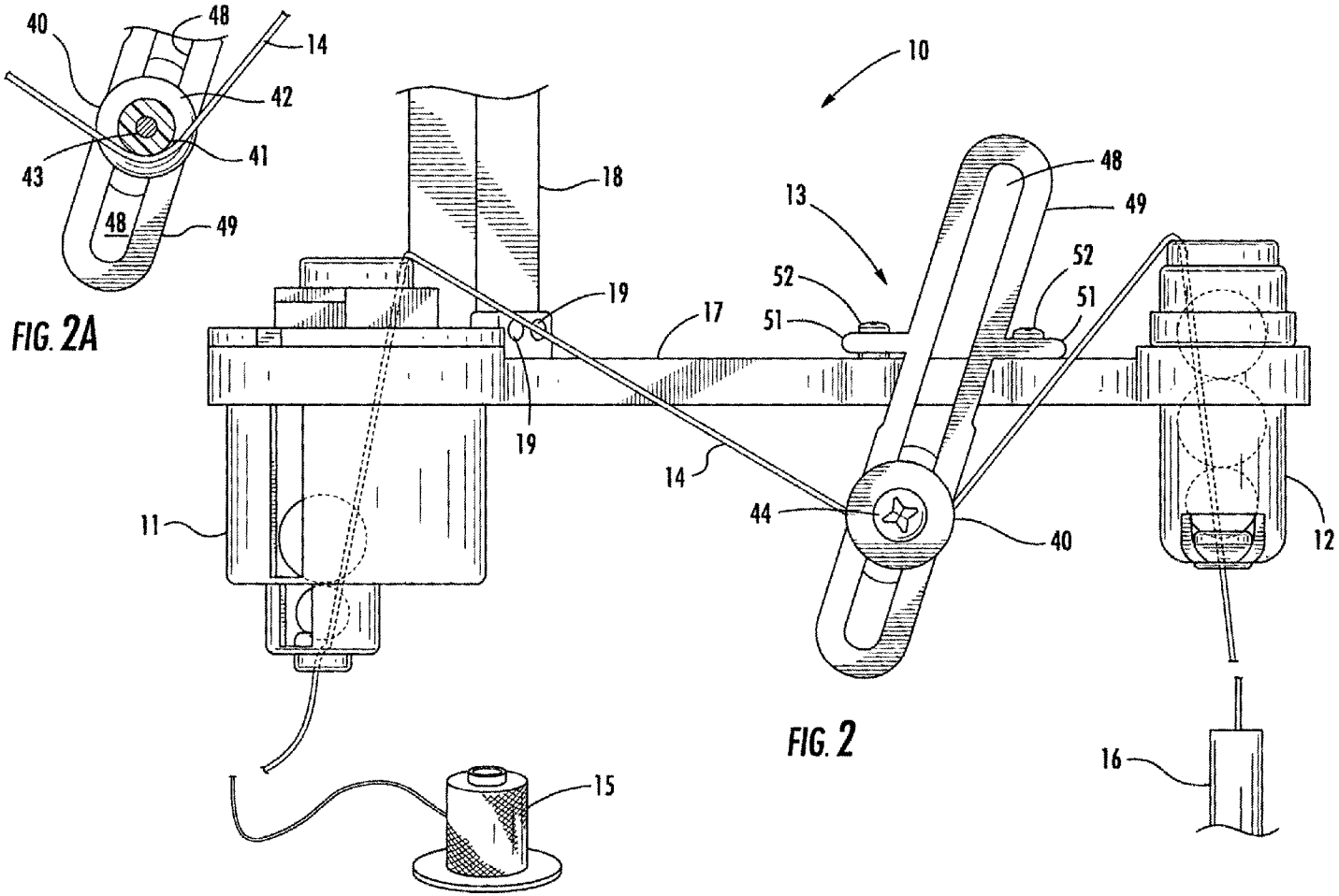
FIG. 2 is an elevational view of a traveling yarn tension compensating system according to the preferred embodiment of the present invention.
FIG. 2A is a vertical sectional view illustrating the extent of yarn contact by the yarn engaging surface in FIG. 2.
Figure 3:
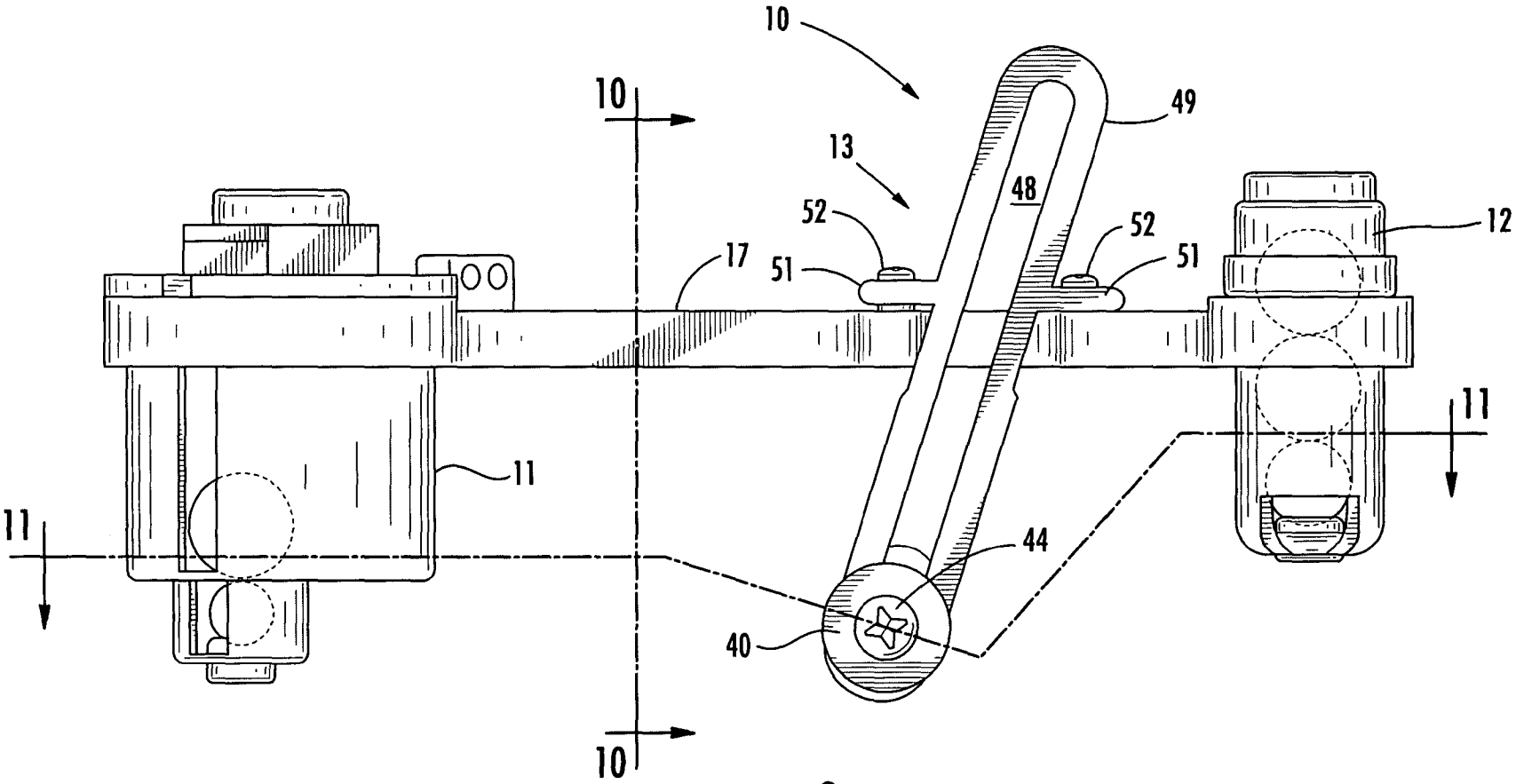
FIG. 3 is a view similar to FIG. 2 without the traveling yarn.
Figure 11:
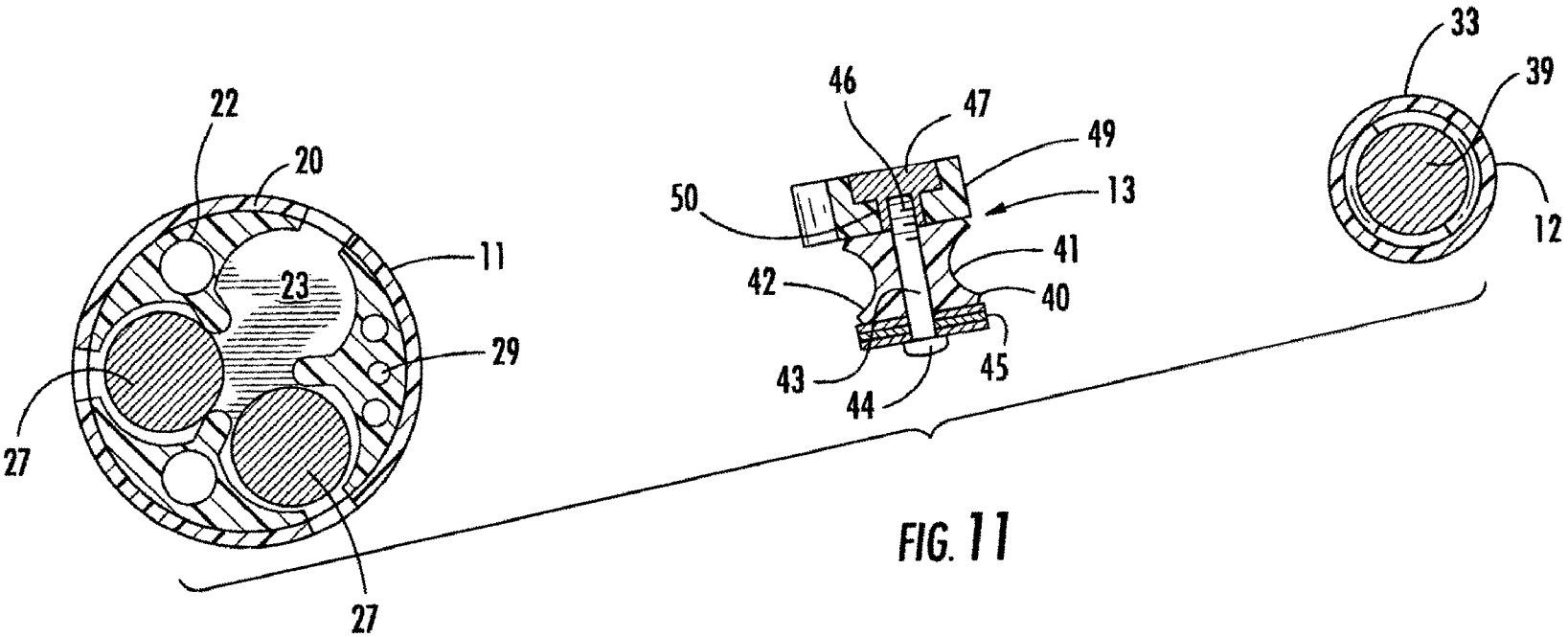
FIG. 11 is a horizontal sectional view of the yarn tension compensating system of FIG. 2, taken along line 11—11 of FIG. 2.
Figure 12:
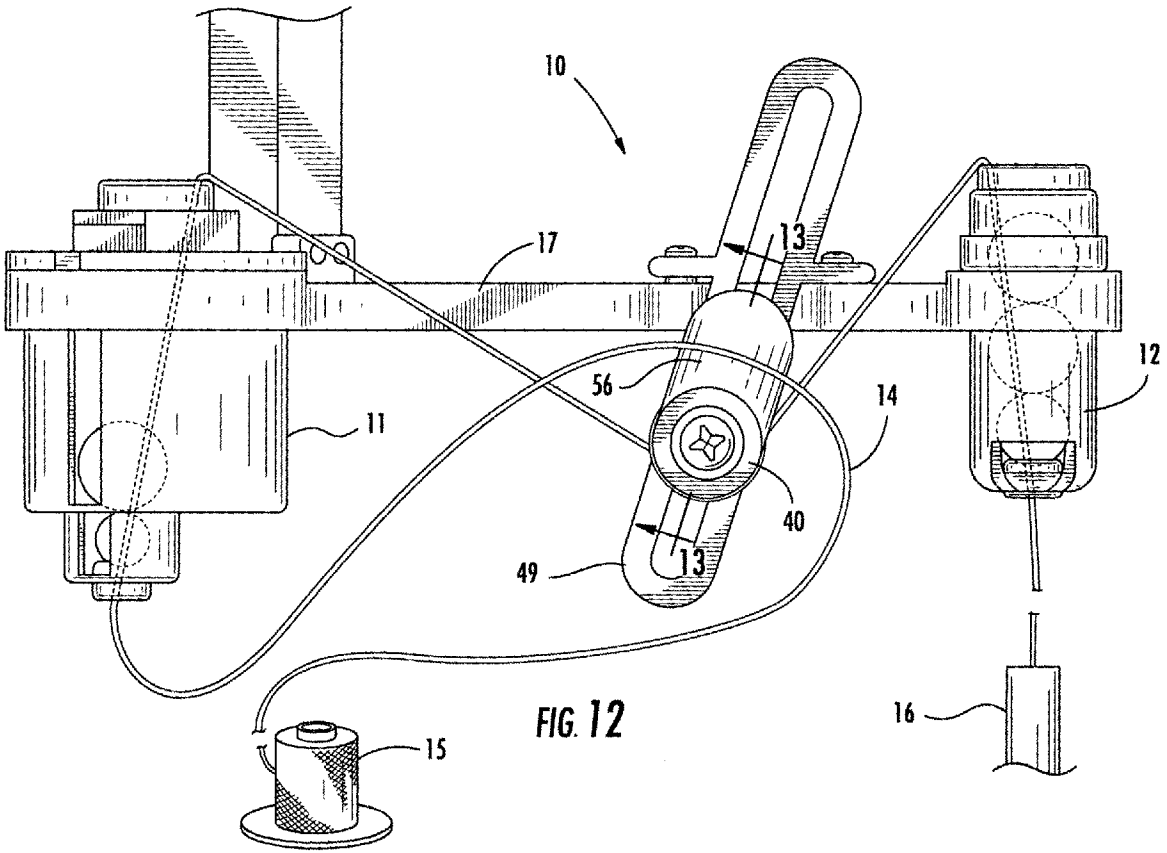
FIG. 12 is a view of the yarn tension compensating system illustrated in FIG. 2 and modified to include a yarn deflecting surface and further illustrating a ballooning or flying yarn being deflected from that surface.
Figure 13:
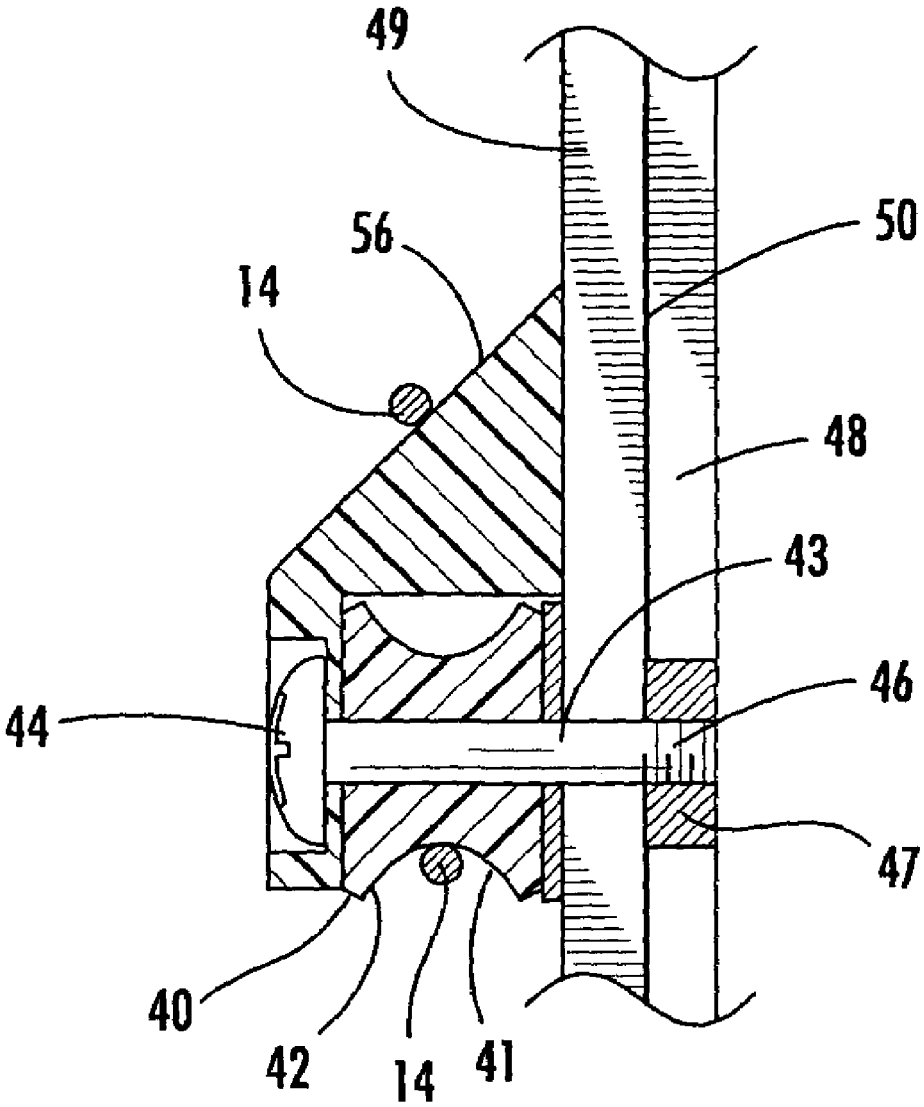
FIG. 13 is a vertical sectional view taken along line 13—13 of FIG. 12.

One of the guiding devices 11 is an input guide, illustrated at the left in FIG. 2. It is a ball-type yarn tensioning unit of the type illustrated and disclosed in the aforementioned Zollinger U.S. Pat. No. 5,820,050. As illustrated most clearly in FIGS. 6 and 11, this yarn tensioning unit 11 has an outer cylindrical housing 20 fixed to the frame 17 and having a downwardly depending yarn receiving chamber 21. An inner cylindrical element 22 is formed with three vertically extending chambers 23 and is rotatable to position a selected one of the chambers in alignment with the yarn receiving chamber 21, which is open at the top to form a continuation with the aligned chamber of the inner element 22. In the bottom of the yarn receiving chamber 21 there is an opening 24 in which an annular ball seat 25, preferably of ceramic material, is located. Seated on the ball seat 25 is a ball 26. The chambers 23 in the inner element 22 contain either no balls or different combinations of balls 27. As illustrated as a representative ball combination in FIGS. 6 and 11, one chamber may have no balls, another chamber may have one ball 27 and a third chamber may have two balls 27 so that when the chambers are selectively aligned with the yarn receiving chamber 21 of the outer housing 20 there may be in the combination chamber only the single ball 26 that is in the yarn receiving chamber 21 or that ball and a ball 27 in a chamber 23 of the aligned inner element 22 or three balls, the one ball 26 in the yarn receiving chamber 21 and two balls 27 in one of the chambers 23 of the inner element 22. The inner element chambers 23 are selectively aligned and retained in alignment with the yarn receiving chamber 21 of the outer housing by inserting a pin through a vertical hole 29 in the inner cylindrical element and a corresponding hole 30 in the bottom of the outer housing 20 when the holes are aligned. At the upper end of the inner element 22 there is a central opening 31 around which is mounted an annular yarn guide 32.

In operation, yarn 14 from the supply package 15 feeds upwardly through the opening 24 in the yarn receiving chamber 21, between the ball seat 25 and the ball 26 that is resting on the ball seat 25. The ball 26 in the yarn receiving chamber 21 and whatever ball 27 that are in the selected inner element chamber 23 aligned with the yarn receiving chamber 21 apply their weight against the yarn 14 at the ball seat 25, thereby applying a restraint thereto, with a resulting creation of tension in the yarn downstream of the balls 21 and 23. The thus tensioned yarn travels upwardly through the opening 24 in the yarn receiving chamber 21, over the annular yarn guide 32 and then horizontally toward the other ball tensioning unit 12. The input yarn tensioning unit 11 is mounted in vertical disposition so that the yarn 14 passes around the annular yarn guide 32, and is subjected to tension increasing restraint by engagement with the surface of the annular yarn guide 32, thereby increasing tension in the yarn 14.

The yarn 14 travels from the input ball tension unit 11, past and in contact with the tension compensating device 13, and to the output yarn tensioning unit 12.

The output ball-type yarn tensioning unit 12 is similar to that disclosed and illustrated in the aforementioned Zollinger U.S. Reissue Pat. No. RE.31,024. It has a cylindrical housing 33 having an upper opening 34 around which an annular yarn guide is mounted. The bottom of the housing 12 has an opening 36 in which an annular ball seat 37 is mounted and on which a ball 38 is seated. In the embodiment illustrated there are two additional balls 39 resting on top of the ball 38. The number of balls utilized is selected to provide a desired degree of tensioning of the yarn as it exits the ball tensioning unit 12.

In operation, yarn 14 traveling from the tension compensating device 13 travels to the output yarn tensioning unit 12, which is vertically disposed so that the yarn passes over the surface of the annular yarn guide 35, which imposes restraint adding to the tension in the yarn. The yarn then passes down through the housing 33 between the ball 38 and ball seat 37, with the ball 38 and the selected number of balls 39 applying a tension increasing weight to the traveling yarn 14 against the seat 37. The traveling yarn then travels into the feed tube 16 of the textile machine with which the yarn tension compensating system 10 is associated.

The above-described input ball tensioning unit 11 and output ball tensioning unit 12 mounted on the frame 17 attached to the structural component 18 of the textile machine, without the tension compensating device 13 of the present invention, is prior art to the present invention. It is the addition of the yarn tension compensating device 13 in this prior art arrangement that is the invention of the preferred embodiment.

The yarn tension compensating device 13 has a yarn engaging element 40 having a yarn engaging surface 41 that is downwardly convex and is formed as the base of a groove 42. For simplicity of manufacture, the yarn engaging element is a commercially available roller made of ceramic material. In the embodiment illustrated, the element 40 is one inch in diameter measured at the outer edge of the groove 42. The groove 42 is U-shaped in cross section, having a base diameter of 5/16 inches. The element 40 has an axial extent of 5/16 inches.

The yarn engaging element 40 is secured against rotation on an axially extending nut and bolt attachment 43 that has a head 44 at one end of the yarn engaging element 40 with metal weighting disks 45 therebetween. The threaded end 46 of the nut and bolt attachment 43 is threadably secured in a T-shaped slide member 47, which is freely movable within the slot 48 of a slide guide 49. The slot 48 is T-shaped in cross section complimentary to the T-shaped cross section of the slide member 47, with the narrower portion 50 of the T-shaped slot 48 being adjacent the yarn engaging element 40 to retain the yarn engaging element 40 slideably mounted on the slide member 49. The slide member 49 is oblong in length in the lengthwise direction of the slot 49 to retain the yarn engaging element 40 in proper orientation. To allow free sliding, the yarn engaging element 40 and the slide member 49 are dimensioned and secured to the nut and bolt attachment 43 so that the slide member 47 and the attached surface engaging element 40 are free for movement within the slot 48 of the slide guide 49.

The slide guide 49 has outer flanges 51 projecting sideways therefrom in horizontal alignment. The flanges 51 are attached to the frame 17 by nuts and bolt attachments 52. The slide guide 49 is formed and mounted on the frame 17 so that the slot 48 is inclined slightly in the direction of yarn travel.

Figures 4, 4A:
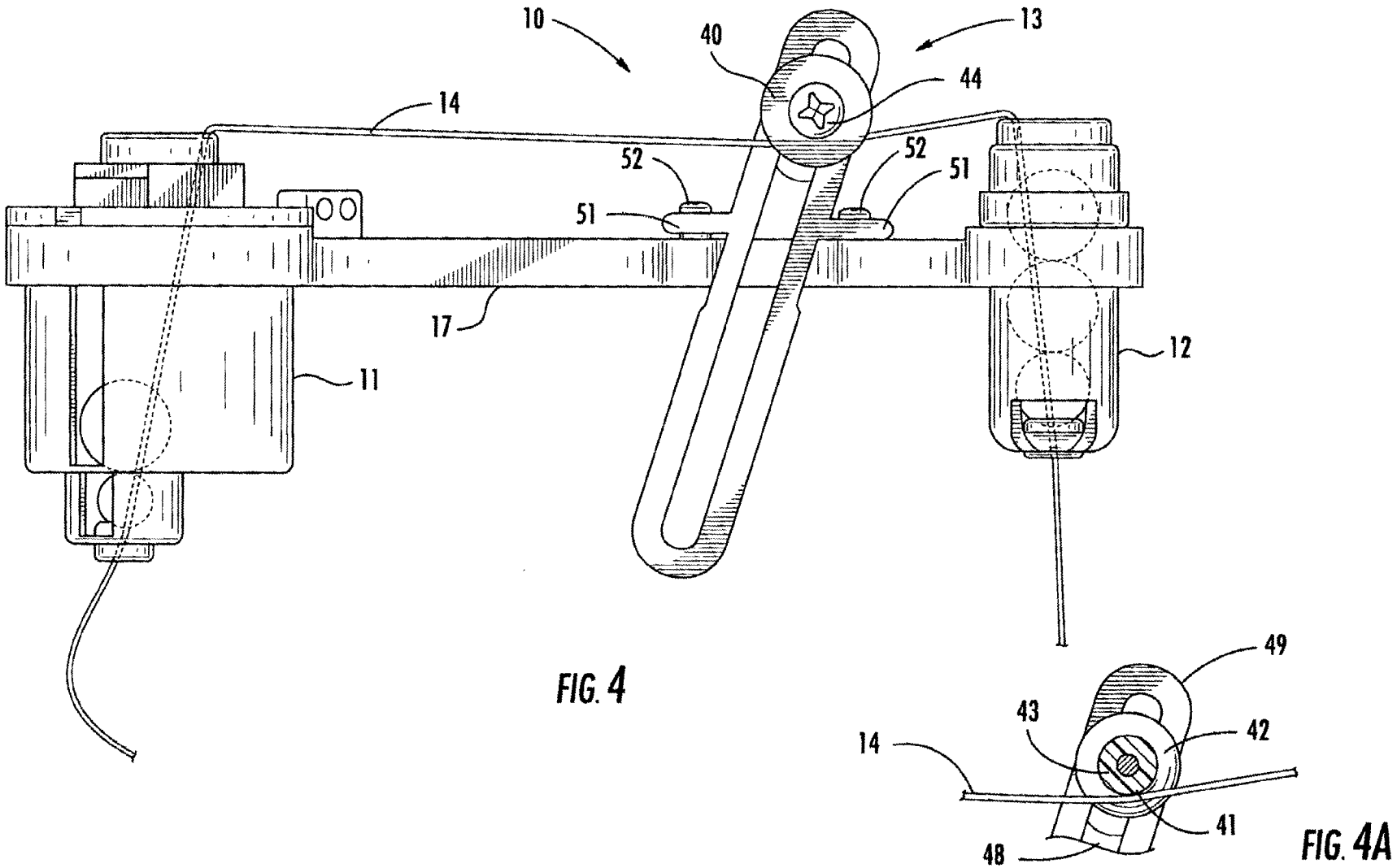
FIG. 4 is a view similar to FIG. 2 illustrating the yarn tension compensating device in an upper position in response to higher tension in the yarn entering the system than is the tension in the yarn entering the system illustrated in FIG. 2.
FIG. 4A is a vertical sectional view illustrating the extent of yarn contact by the yarn engaging surface in FIG. 4.
Figure 5:
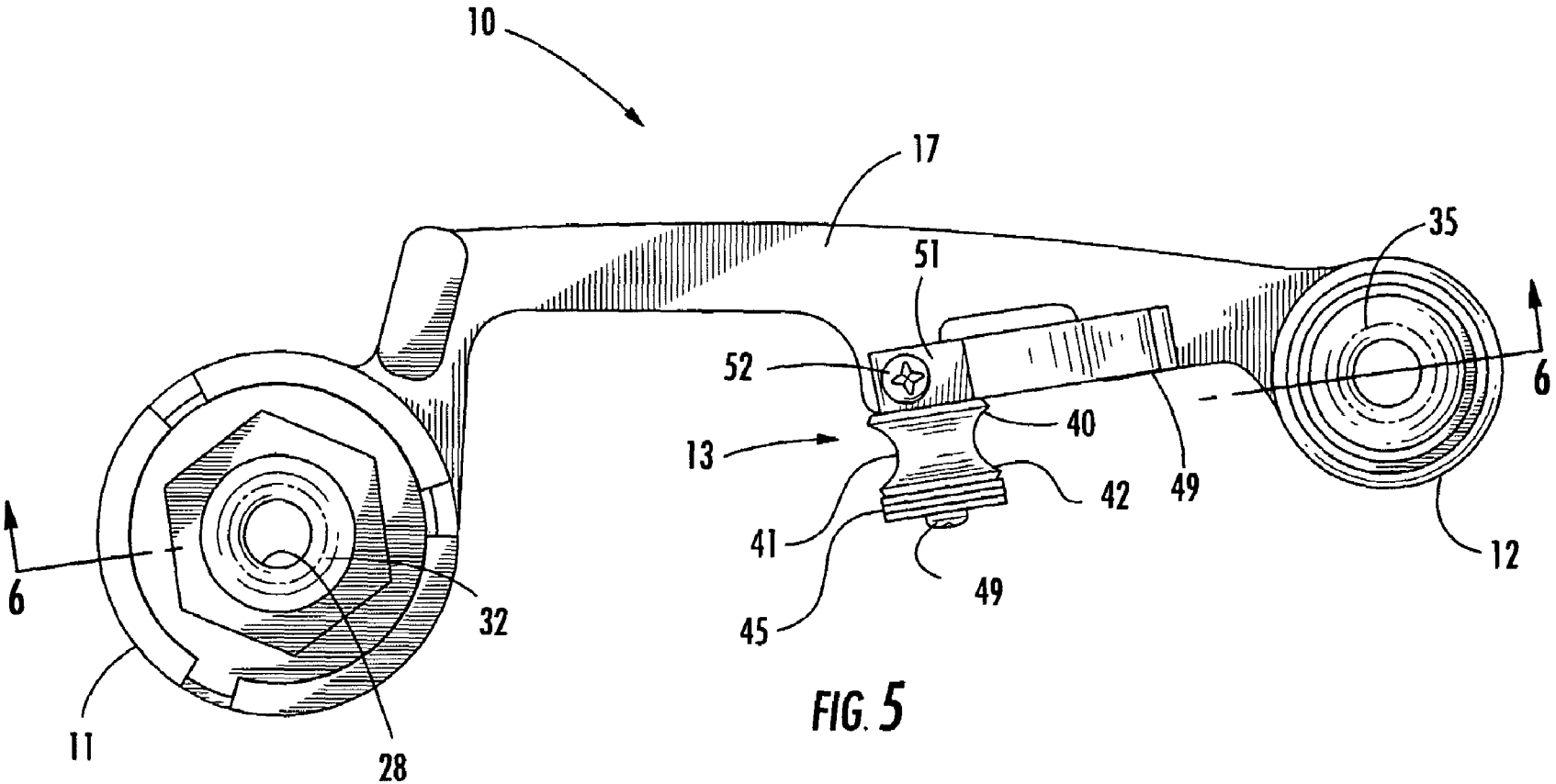
FIG. 5 is a top plan view of the traveling yarn tension compensating system illustrated in FIG. 3.
Figure 6:
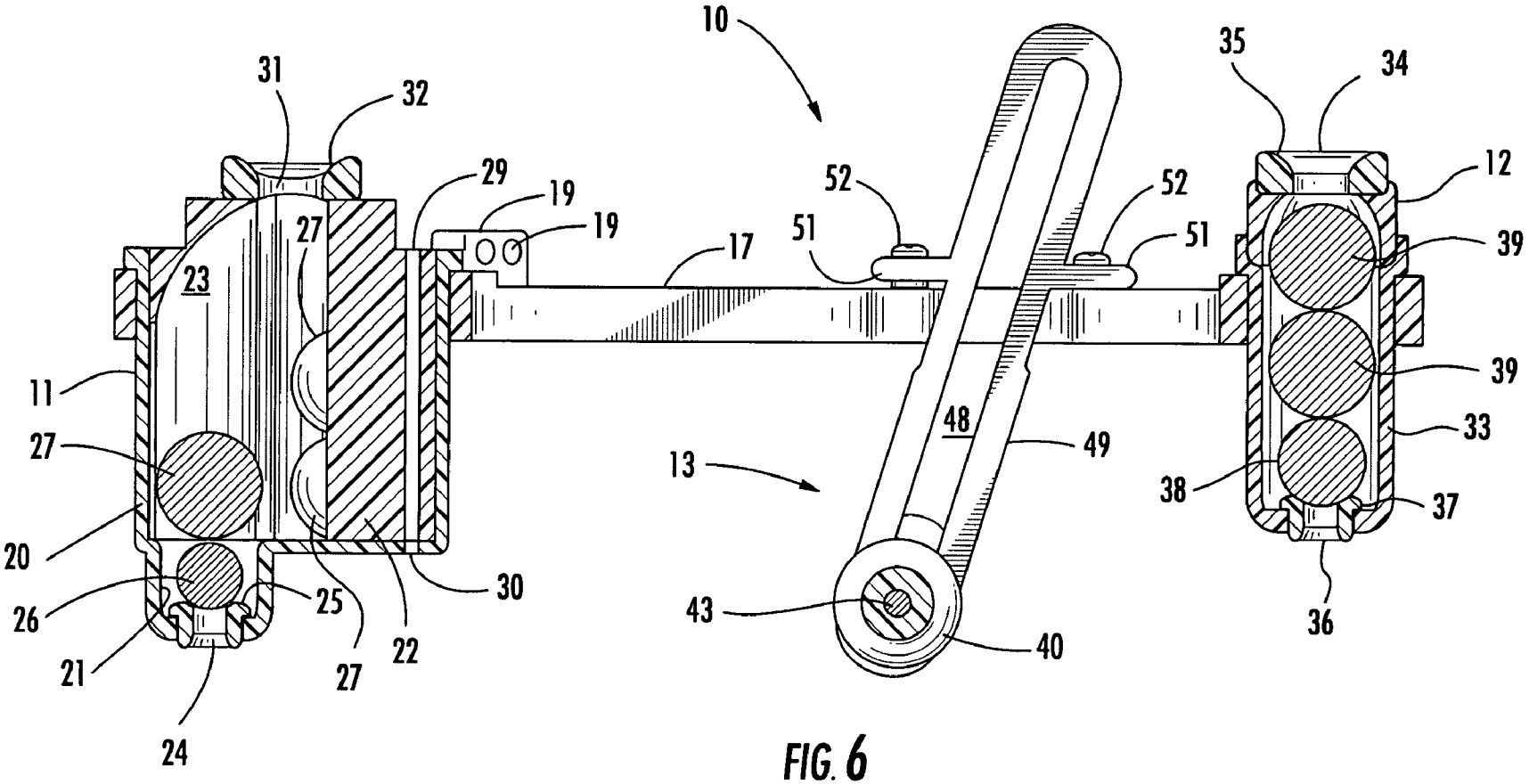
FIG. 6 is a vertical sectional view taken along line 6—6 of FIG. 5.
Figure 7:
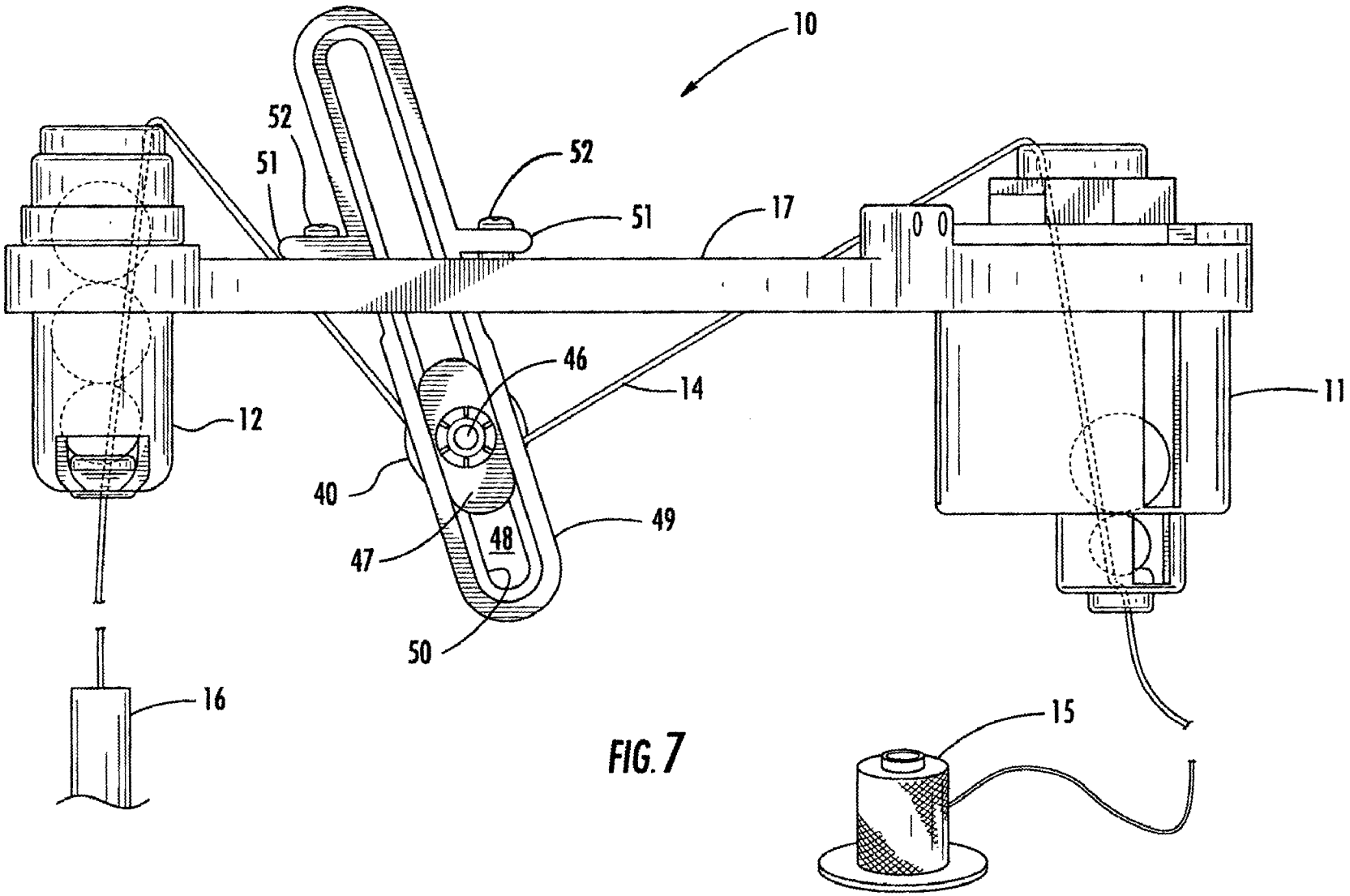
FIG. 7 is an elevational view of the yarn tension compensating system illustrated in FIG. 2 as viewed from the opposite side.
Figure 8:
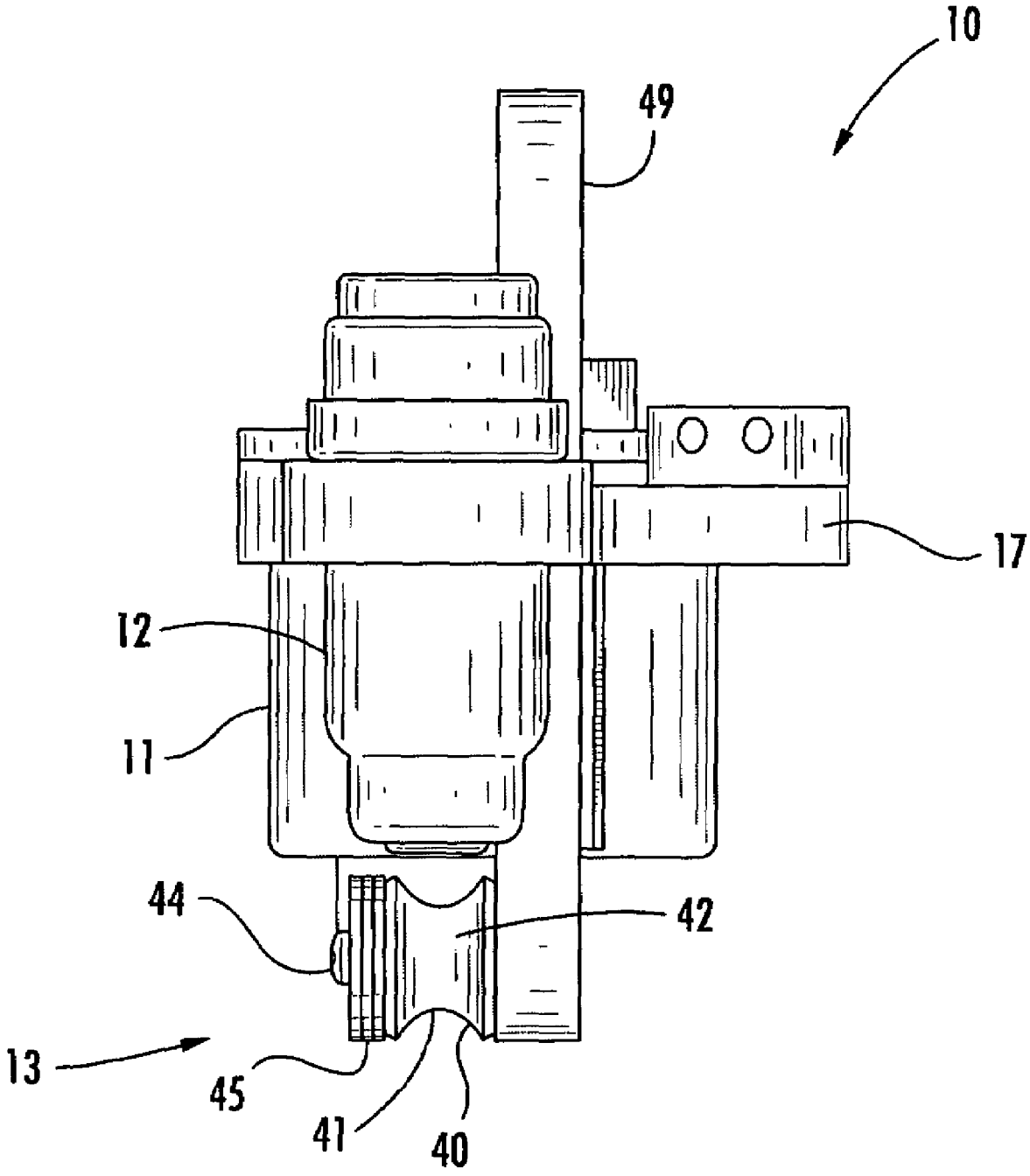
FIG. 8 is an end elevation of the yarn tension compensating system of FIG. 3 as viewed from the right end of FIG. 3.
Figure 9:
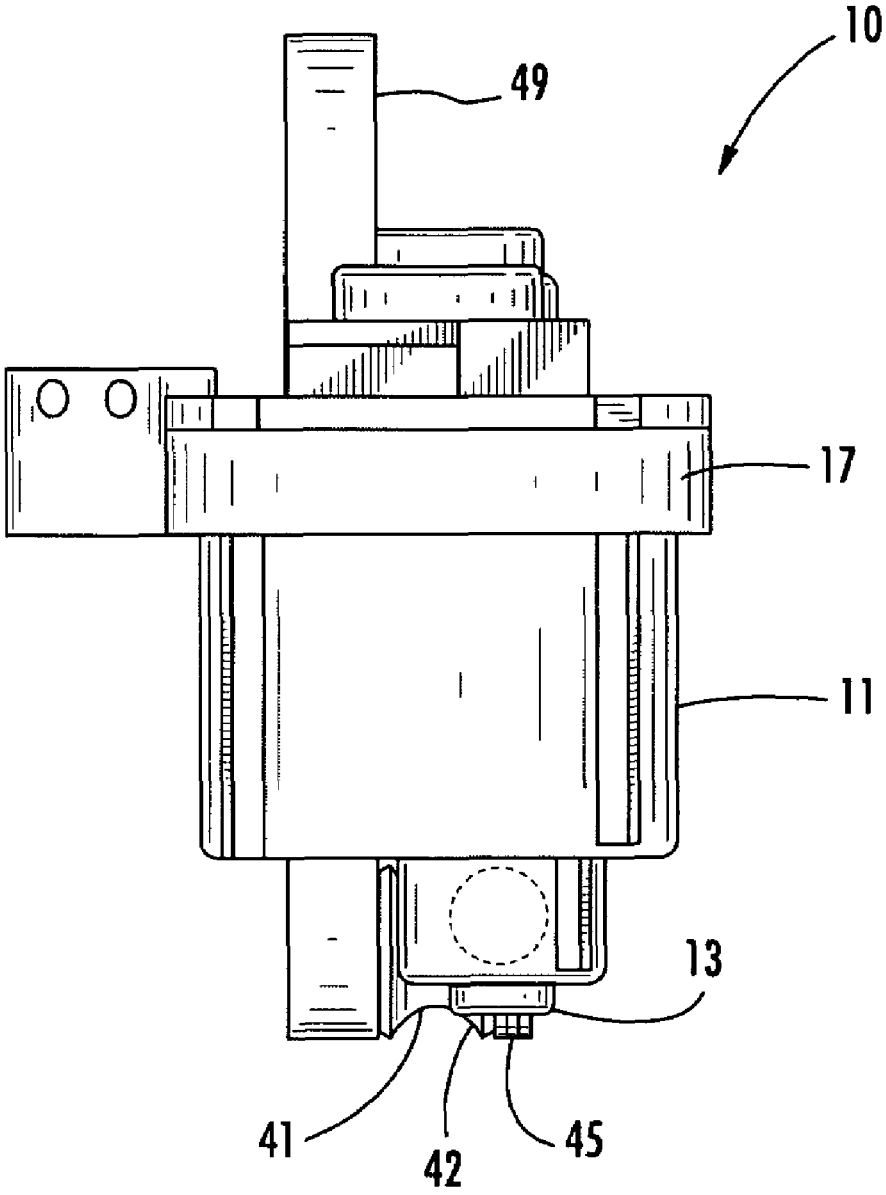
FIG. 9 is an end elevation of the yarn tension compensating system of FIG. 3 as viewed from the left end of FIG. 3.
Figure 10:
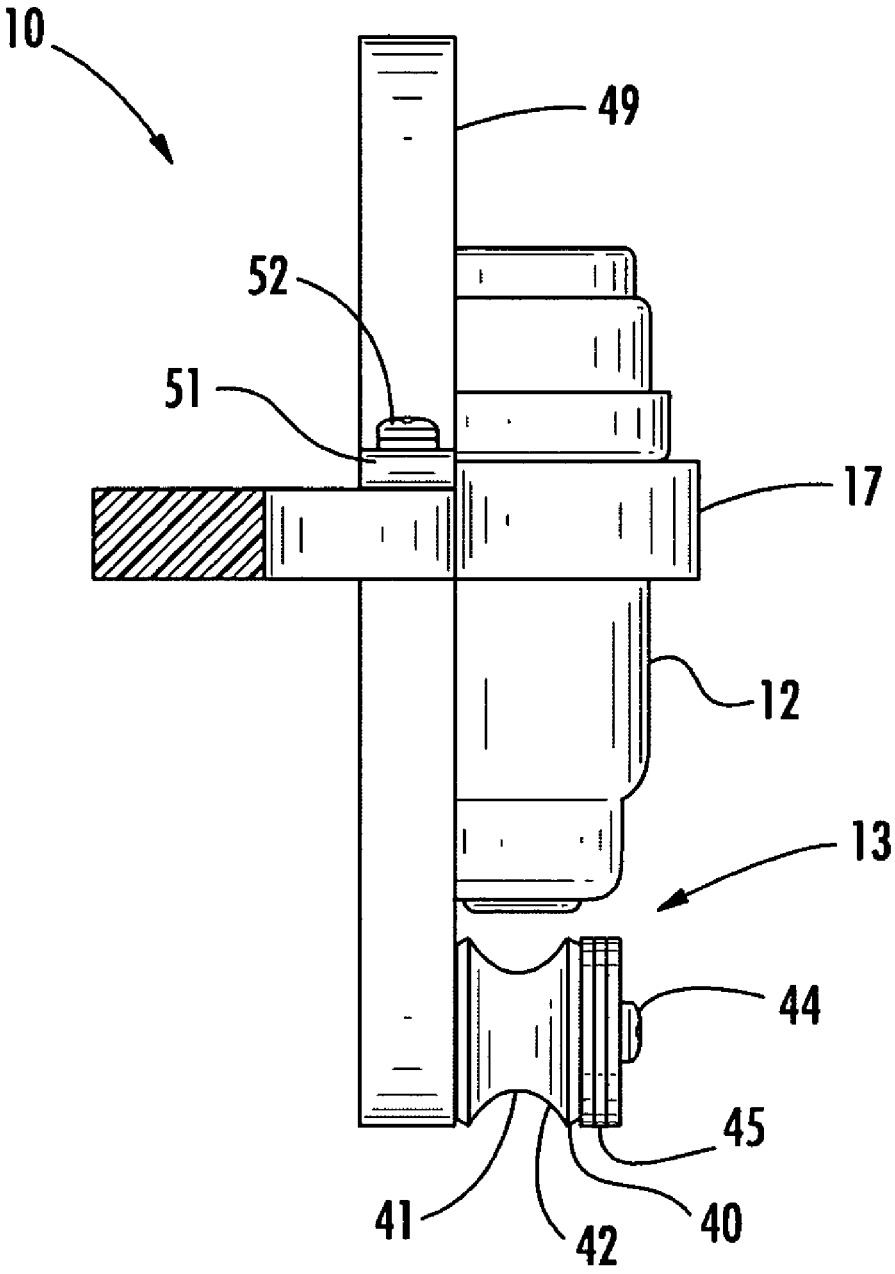
FIG. 10 is a vertical sectional view as viewed along line 10–10 of FIG. 3.

The slide guide 49 is dimensioned so that the slot extends sufficiently for the surface engaging element to have an upper position engaging the yarn 14 when the yarn 14 extends substantially horizontally between the ball tension units 11 and 12, as illustrated in FIG. 4, and a lower position selected to provide the greatest downward deflection of the yarn 14, as shown in FIG. 6.

The weighting disks 45 are selected to provide sufficient weight for the weight of the yarn engaging element 40 to deflect the yarn downwardly to a lower position, such as illustrated in FIG. 2, during expected normal operation. However, it may be difficult to tune the system so that the yarn engaging element 40 is above the bottom of the slot during normal operation. For this reason, it is acceptable for the weight of the yarn engaging element 40 to be such that the yarn engaging element 40 rests on the bottom of the slot 48 during normal operation. In any event, the weight should be light enough that the surface engaging element 40 will move upwardly substantially when there is a sudden change in the tension in the traveling yarn, such as when there is a snag or tangle in the yarn 40 being withdrawn from the supply package 15 that imposes a resistance to the draw off, causing an increase in the yarn tension.

Importantly, the yarn engaging surface frictionally engages the yarn, thereby adding to the tension in the yarn exiting the system 10. The extent of this surface engagement at or near the lower most deflection is illustrated in FIG. 2A. On the other hand, when there is an increase in tension in the traveling yarn 14, the tension in the traveling yarn will cause the surface engaging element to rise to a higher position, at which there is less extent of surface engagement of the yarn 10 by the friction surface 41, as illustrated, for example, in FIG. 4B.

The inclination of the slide guide 49 in the direction of yarn travel facilitates free movement of the yarn engaging element 40 upwardly in response to an increase in yarn tension.

An example of the use of the system 10 of the present invention, is in a yarn cabler where yarn, such as a synthetic filament yarn of 1100 denier, is drawn from a supply package 15 at a relatively low normal speed of about 50 yards per minute. The yarn engaging element 40 is made of ceramic material selected to apply desired frictional engagement of the yarn 14. The weighting of the element 40 is selected so that in normal running of the yarn 14 the yarn engaging element 40 will be slightly above or at the bottom of the slot 48 of the slide guide 49, deflecting the yarn and thereby causing maximum tension increasing restraint to the traveling yarn as it is deflected around the yarn guides and the yarn engaging surface of the yarn engaging element, but with the weighting allowing upward movement of the element 40 upon an increase in the tension in the running yarn, at which upper position there will be less tension imposed by the yarn guides and the yarn engaging surface.

In operation of the yarn tension compensating system 10 of the present invention, there may be instances where the yarn 14 from the supply package 15 is ballooning or flying before entering the input guiding unit 11 to such extent that it could get caught on the top of the yarn engaging element 40, particularly where the yarn engaging surface 41 is formed in an annular groove 42. To prevent this entanglement in use of the system where such entanglement is a possibility, the yarn engaging element 40 is extended upwardly and provided with a yarn deflecting surface 56 disposed above the yarn engaging surface 41 and inclined downwardly and outwardly for preventing yarn from entering the groove 42 and deflecting the yarn away from the yarn tension compensating device 13.

While the above-described preferred embodiment and use thereof discloses a structure and application in which the present invention is particularly useful, the structure and operation of the present invention is capable of variation as desired. For example, the yarn engaging surface could be rotatable, provided the rotation is restrained sufficiently that the surface speed of the yarn engaging surface is less than the running speed of the traveling yarn engaging the surface so that there will be a desired amount of frictional drag imposing tension on the traveling yarn.

The ball tensioning units need not be horizontally level so long as there is a sufficient horizontal extent of the spacings for operable yarn contacting engagement of the yarn on the yarn engaging surface.

It is also within the scope of the present invention to utilize a yarn engaging surface on a fixed member with the surface being convex upwardly for engagement under the yarn and a movable hold-down element holding the yarn in surface engagement on the yarn engaging surface and movable generally vertically to vary the extent of yarn engaging contact with the surface.

In view of the aforesaid written description of the present invention, it will be readily understood by those persons skilled in the art that the present invention is susceptible of broad utility and application. Many embodiments and adaptations of the present invention, other than those herein described, as well as many variations, modifications, and equivalent arrangements, will be apparent from or reasonably suggested by the present invention and the foregoing description thereof, without departing from the substance or scope of the present invention. Accordingly, while the present invention has been described herein in detail in relation to preferred embodiments, it is to be understood that this disclosure is only illustrative and exemplary of the present invention and is made merely for purposes of providing a full and enabling disclosure of the invention.

The disclosure herein is not intended nor is to be construed to limit the present invention or otherwise to exclude any such other embodiments, adaptations, variations, modifications and equivalent arrangements, the present invention being limited only by the claims appended hereto and the equivalents thereof.

What is claimed is:

1. A traveling yarn tension compensating system comprising a pair of generally horizontally spaced yarn guiding devices for guiding yarn for travel therebetween, and a yarn tension compensating device disposed between said yarn guiding devices for engaging the yarn traveling between said yarn guiding devices and having a yarn engaging surface that applies frictional restraint to the traveling yarn, said yarn engaging device being responsive to variations in tension in the yarn traveling from one guiding device to the other to increase or decrease the tension applied to the yarn, said yarn engaging surface being convex with the extent of yarn engagement by the convex surface decreasing in response to an increase in tension of the yarn traveling from said one guiding device.

2. The traveling yarn tension compensating system of claim 1 characterized further in that said yarn tension compensating device includes an element resting on the traveling yarn and deflecting the yarn downwardly between said guiding devices, said element being movable with a vertical component of movement in response to tension in the yarn from a lower position at which the extent of engagement of the yarn by the yarn guides and the yarn engaging surface is greater and upper positions at which the extent of engagement of the yarn by the yarn guides and the yarn engaging surface is less.

3. The traveling yarn tension compensating system according to claim 2 characterized further in that said yarn engaging surface is formed on said movable element and is downwardly convex.

4. The traveling yarn tension compensating system of claim 3 characterized further in that said yarn engaging surface is restrained so that it is not free to move at the same surface speed as the traveling yarn.

5. The traveling yarn tension compensating system according to claim 4 characterized further in that said moveable element is fixed against movement in the direction of yarn travel.

6. The traveling yarn tension compensating system according to claim 2 characterized further in that said element is freely movable in a substantially vertical direction in response to tension in the traveling yarn.

7. The traveling yarn tension compensating system of claim 6 characterized further in that said movable element is in the form of a movable slide and a generally vertically extending slide guide engages the slide element to guide it in substantially vertical movement.

8. The traveling yarn tension compensating system of claim 7 characterized further in that said slide guide has a slot and said movable slide element has a follower portion engaged in said slot.

9. The traveling yarn tension compensating system according to claim 6 characterized further in that said movable element is movable upwardly at an inclination to the vertical in a direction inclined toward the yarn guiding device to which the yarn travels.

10. The traveling yarn tension compensating system according to claim 7 characterized further in that said slide guide is inclined from the vertical toward the direction in which the yarn travels.

11. The traveling yarn tension compensating system of claim 1 characterized further in that said convex surface is formed as the base of a groove.

12. The traveling yarn tension compensating system according to claim 7 characterized further by an inclined yarn deflecting surface formed on said slide element above said yarn engaging surface to deflect yarn away from said yarn tension compensating device yarn contacting said slide element before being guided by said one yarn guiding device.

13. A traveling yarn tension compensating system comprising a pair of generally horizontally spaced yarn guiding devices for guiding yarn for travel therebetween, and a yarn tension compensating device disposed between said yarn guiding devices for engaging the yarn traveling between said yarn guiding devices and having a yarn engaging surface that applies frictional restraint to the traveling yarn, said yarn engaging device being responsive to variations in tension in the yarn traveling from one guiding device to the other to increase or decrease the tension applied to the yarn, said yarn guiding devices being vertically disposed ball-type yarn tensioning units having upper yarn guides, said units being arranged for yarn to travel upwardly through one of said units over its upper yarn guide, past said yarn tension compensating device, over the upper yarn guide of the other unit, and down through the other unit.

14. The traveling yarn tension compensating system according to claim 13 characterized further by a frame on which the yarn guiding devices and the yarn tension compensating device are mounted.

15. The traveling yarn tension compensating system according to claim 13 characterized further by a frame on which said ball-type tensioning units and said yarn tension compensating device are mounted.

16. A traveling yarn tension compensating system comprising a pair of generally horizontally spaced yarn guiding devices for guiding yarn for travel therebetween, and a yarn tension compensating device disposed between said yarn guiding devices for engaging the yarn traveling between said yarn guiding devices and having a yarn engaging surface that applies frictional restraint to the traveling yarn, said yarn engaging device being responsive to variations in tension in the yarn traveling from one guiding device to the other to increase or decrease the tension applied to the yarn, said yarn tension compensating device includes an inclined yarn deflecting surface disposed above said yarn engaging surface for deflecting yarn away from said yarn tension compensating device before being guided by said one yarn guiding device.

* * * * *